US006452162B1

(12) United States Patent
Matsuno et al.

(10) Patent No.: US 6,452,162 B1
(45) Date of Patent: Sep. 17, 2002

(54) REPEATER OF TANDEM SENSOR SYSTEM

(75) Inventors: Hisashi Matsuno; Tetsu Sugihara; Tetsuo Koike; Yousuke Kusano, all of Tokyo (JP)

(73) Assignee: Yamatake Corporation, Tokyo (JP)

( * ) Notice: Subject to any disclaimer, the term of this patent is extended or adjusted under 35 U.S.C. 154(b) by 0 days.

(21) Appl. No.: 09/674,626

(22) PCT Filed: Mar. 10, 2000

(86) PCT No.: PCT/JP00/01485

§ 371 (c)(1),
(2), (4) Date: Oct. 31, 2000

(87) PCT Pub. No.: WO00/54239

PCT Pub. Date: Sep. 14, 2000

(30) Foreign Application Priority Data

Mar. 11, 1999 (JP) ..... 11-065497

(51) Int. Cl.[7] ..... H01J 5/02
(52) U.S. Cl. ..... 250/239; 250/551
(58) Field of Search ..... 250/239, 551, 250/214 R; 439/35, 152, 153, 155; 385/53

(56) References Cited

U.S. PATENT DOCUMENTS 4,241,509 A 12/1980 Possati
4,557,534 A * 12/1985 Dahnert ..... 312/198

FOREIGN PATENT DOCUMENTS

| | | |
|---|---|---|
| JP | 7-6286 | 1/1995 |
| JP | 7-57178 | 3/1995 |
| JP | 7-122318 | 5/1995 |

* cited by examiner

*Primary Examiner*—Que T. Le
(74) *Attorney, Agent, or Firm*—Frishauf, Holtz, Goodman & Chick, P.C.

(57) ABSTRACT

A relay device for a concatenated sensor system includes first and second relay units (14, 16) and a relay cable (28) connecting the two relay units. When the first relay unit is located in intimate contact with one side of a sensor unit (8) that is situated at one end of a sensor unit group (4) or with one side of a master unit (2), a linking connector of the relay unit is connected to an input-output connector provided on one side of the master unit or on one side of the sensor unit. When the second relay unit is located in intimate contact with the other side of a sensor unit that is situated at the other end of a sensor unit group (4 or 6), a linking connector of the relay unit is connected to an input-output connector provided on the other side of the sensor unit. Thus, electrical connection between the master unit and the sensor unit group and between the sensor unit groups of the concatenated sensor system can be established with reliability.

8 Claims, 4 Drawing Sheets

REPEATER OF TANDEM SENSOR SYSTEM

TECHNICAL FIELD

The present invention relates to a concatenated sensor system comprised of a plurality of concatenated sensor units, and more particularly, to a relay device for electrically connecting adjacent ones of a plurality of sensor unit groups arranged to be spaced in a concatenated sensor system or a master unit and a sensor unit group adjacent thereto.

BACKGROUND ART

For control of operations of various manufacturing apparatuses, detection information detected by a plurality of sensor units of a sensor system are used in some cases. For instance, each sensor unit is composed of a sensor unit body and a detecting element connected thereto. The detecting element is located to face an object of detection in a manufacturing apparatus. The detection information detected by the detecting element is delivered to a controller of the sensor system through the sensor unit body.

In order to reduce the arrangement space of the sensor system of this type and shorten signal cables (signal conductors) used for transfer of signals between the detecting elements and the sensor unit bodies and between the sensor unit bodies and the controller, a concatenated sensor system may be used. The concatenated sensor system has sensor unit bodies thereof provided with male and female input-output connectors and is so arranged that the respective input-output connectors of the adjacent sensor unit bodies are connected to one another when the sensor unit bodies are disposed on a base in intimate contact with one another.

In the concatenated sensor system, a master unit may be provided between the controller of the sensor system and the sensor unit groups. The master unit has a setting section for collectively settings detection threshold values for the detecting elements and a display section for collectively displaying operating states of the individual sensor units.

As described above, the concatenated sensor system has such an advantage that a large number of sensor units can be arranged in intimate contact with one another, thereby reducing the arrangement space. However, depending on an object to which the system is applied, a detection signal transmission line extending from the detecting element to the sensor unit body may be lengthened, so that the detecting performance can be lowered.

In the case where the concatenated sensor system is used to detect the presence of a workpiece on the side upstream of a coating machine and check the workpiece for coating on the side downstream of the coating machine, for example, a detecting element for workpiece detection and a detecting element for coating detection are spaced from each other. Irrespective of the location of the concatenated sensor system relative to the coating machine, therefore, the distance from the sensor system to the detecting element for workpiece detection or to the detecting element for coating detection becomes long to the extent that a long signal cable (signal conductor) must be used to connect the detecting element and the sensor unit body.

In this case, laying the signal cable is laborious, and the detection information may possibly be attenuated during the transfer through the signal cable, to lower the detecting performance. When an optical fiber (optical fiber cable) is used for the signal transmission, the optical fiber cannot be laid with ease since it is more susceptible to bending than an electric cable is. If the optical fiber has a lot of bent portions, the detecting performance of the sensor units may be lowered.

This awkward situation may possibly be removed by dividing the sensor units of the concatenated sensor system into a plurality of sensor unit groups and locating the individual sensor unit groups in the vicinity of the detection objects. According to the sensor system of this type, the distance between the sensor unit body and the detecting element in each sensor unit group is short, so that the signal cable can be shortened, and lowering of the detecting performance that is attributable to the attenuation of the detection information can be avoided.

On the other hand, signal transmission is required between the sensor unit groups. In brief, two sensor units that are situated individually at the opposed ends of each two adjacent sensor unit groups can be connected to each other by means of a relay cable provided with connectors. That is, the two sensor units can be connected to each other by plugging the connectors at the opposite ends of the relay cable into connectors on the two sensor units, whereby the adjacent sensor unit groups can be connected.

However, the connection between the relay cable and the sensor units, established by means of the connectors, is not strong enough, and therefore, if a tensile force acts on the relay cable, the connectors of the relay cable may possibly be disengaged from the connectors of the sensor units. If lock mechanisms are provided on the connectors of the sensor units to prevent the disengagement of the connectors, the sensor units become complicated in construction and entail higher cost. The lock mechanism on one of each two adjacent sensor unit groups projects toward the lock mechanism on the other sensor unit group, and therefore, if the adjacent sensor unit groups are expected to be located close to each other, such close location cannot be realized. Although the connectors of the relay cable can be fastened to the sensor units with use of screws so that they are prevented from disengagement, the sensor units require a space for female screw formation, so that the sensor units are large-sized and cost high.

DISCLOSURE OF THE INVENTION

An object of the present invention is to provide a relay device that can securely electrically connect adjacent ones of a plurality of sensor units or sensor unit groups arranged to be spaced in a concatenated sensor system or connect a master unit and a sensor unit or sensor unit group disposed adjacent thereto.

In order to achieve the above object, according to the present invention there is provided a relay device for a concatenated sensor system including a first unit group comprised of at least one sensor unit or a master unit and a second unit group comprised of at least one sensor unit.

The relay device for the concatenated sensor system of the present invention comprises a first relay unit adapted to be juxtaposed in intimate contact with one side of the first unit group and adapted to be fixed, together with the first unit group, to a first base, the first relay unit including a first linking connector electrically connectable with a first input-output connector provided on the one side of the first unit group; a second relay unit adapted to be juxtaposed in intimate contact with another side of the second unit group and adapted to be fixed, together with the second unit group, to a second base, the second relay unit including a second linking connector electrically connectable with a second input-output connector on another side of the second unit group; and a relay cable electrically connecting the first relay unit and the second relay unit.

According to the relay device of the present invention, when the first and second relay units are juxtaposed in intimate contact with the first and second unit groups, the linking connectors of the first and second relay units are connected to the input-output connectors of the first and second unit groups, respectively. Electrical connection between the first and second unit groups can be established by connecting the first and second relay units through the relay cable.

Thus, the relay device of the present invention is used to connect a plurality of unit groups of the concatenated sensor system. By means of the relay device, a plurality of sensor units, a plurality of sensor unit groups, or the master unit and the sensor unit or the sensor unit group, for instance, can be connected to one another.

More specifically, if each of the first and second unit groups is formed of a sensor unit group, the linking connectors of the first and second relay units are connected individually to the input-output connectors on the sensor units that are situated individually at the opposed ends of the two sensor unit groups, and the two sensor unit groups are connected to each other by means of the relay cable. If each of the first and second unit groups is formed of one sensor unit, the two sensor units are connected by means of the relay cable. If the first unit group is formed of the master unit and if the second unit group is formed of the sensor unit or sensor unit group, the master unit and the sensor unit or the sensor unit group are connected by means of the relay cable.

In the case where the unit groups of the concatenated sensor system are spaced from one another, therefore, the adjacent unit groups can be connected by means of the relay device, so that each sensor unit can be located near a detection object to reduce the length of a signal conductor extending from the sensor unit to the detecting element. Thus, the signal conductor can be laid with ease, and the detecting performance of the sensor system can be ensured. Moreover, according to the present invention where the relay cable is arranged to be connected to the first and second relay units, the sensor unit or master unit need not be provided with any connecting means, such as a connector, adapted to be connected with the relay cable. This makes it possible to avoid complication of the configuration and increase in cost, which are attributable to the formation of the connecting means to the sensor unit or the master unit. According to the present invention, moreover, the first relay unit is fixed together with the first unit group to the first base, while the second relay unit is fixed together with the second unit group to the second base, which is identical with or separate from the first base, so that stability in use is satisfactory.

Preferably, in the present invention, the relay cable is connected to the first and second relay units at those outer surfaces of the first and second relay units which extend in the direction of arrangement of the first and second unit groups. With this preferred arrangement, the opposite surfaces of the first and second unit groups need not be provided with any connecting means that is adapted to be connected with the relay cable, thereby preventing increase in the dimensions, caused by the provision of the connecting means, of each of the first and second unit groups as viewed in the direction of arrangement of these unit groups. Thus, the first and second unit groups can be located close to each other as required.

In this preferred arrangement, the relay cable may have opposite ends thereof provided with connectors that are adapted to be connected individually to relay connectors provided on the outer surfaces of the first and second relay units. In this case, the electrical connection between the relay cable and the first and second relay units can be easily established by means of the connectors, and the connectors of the relay cable cannot be easily disengaged from the relay connectors even if a tensile force acts on the relay cable, since these connectors are provided on the outer surfaces.

In the present invention, preferably, end plates are arranged in intimate contact with that side of the first relay unit which is remote from the first unit group and that side of the second relay unit which is remote from the second unit group, the end plates being fixed to the first and second bases, individually. In this case, the first relay unit and the first unit group (sensor unit, sensor unit group, or master unit), as well as the second relay unit and the second unit group, can be kept in intimate contact with each other.

In the case where at least one of the first and second unit groups is a sensor unit group composed of a plurality of sensor units, the end plates are each arranged in intimate contact with that side of the sensor unit group which is remote from the relay unit and each fixed to the corresponding one of the first and second bases. In this case, the sensor unit group and the relay unit can be securely fixed between a pair of end plates.

Preferably, the concatenated sensor system of the present invention comprises a signal conductor extending from each of the sensor units to a detecting element thereof, the signal conductor being formed of an optical fiber. In the present invention, the signal conductor of each sensor unit can be shortened, so that bent portions of the signal conductor can be reduced in number. Even in the case where the signal conductor is formed of the optical fiber, therefore, deterioration of the signal transmission characteristic caused by bending of the optical fiber can be suppressed, and a detection signal from the detecting element can be satisfactorily transmitted to the sensor unit.

Preferably, in the present invention, at least one of the relay units includes a communication driver between the linking connector and the relay cable. The communication driver increases a signal transmission ability of the relay unit and allows elongation of the relay cable.

Further, the relay unit provided with the communication driver may include power supply means through which external power is supplied to the communication driver. In this case, the signal transmission ability of the communication driver can be further increased.

BEST MODE FOR CARRYING OUT THE INVENTION

Figure 1:
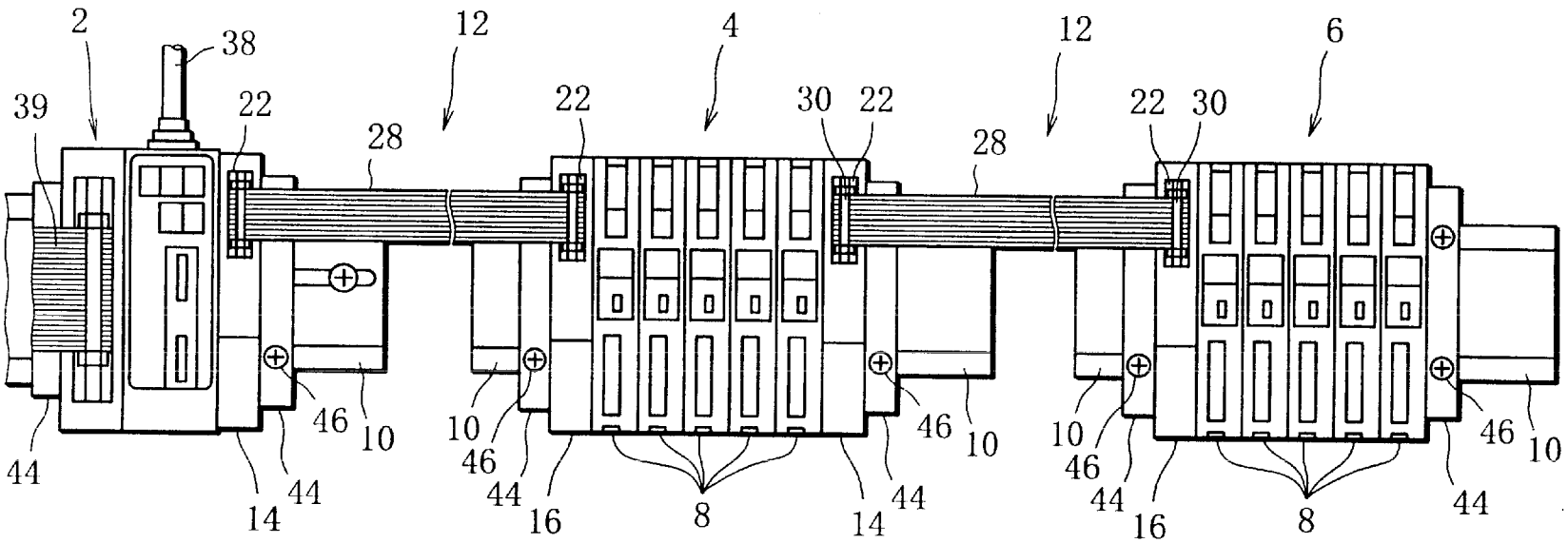
FIG. 1 is a schematic plan view showing an example of a concatenated sensor system.

Referring to FIG. 1, a concatenated sensor system comprises a master unit 2 and two sensor unit groups 4 and 6.

Each of the sensor unit groups 4 and 6 is comprised of a plurality of sensor units 8 formed into a rectangular shape. These sensor units 8 are juxtaposed in a line on a so-called DIN rail 10 for use as a base in such a manner that their respective outside walls are in intimate contact with one another. Each sensor unit 8 has a male input-output connector (denoted by reference numeral 15 in FIG. 2) on one of its opposite outside walls and a female input-output connector (denoted by reference numeral 17 in FIG. 2) on the other outside wall. In each sensor unit group, two adjacent sensor units 8 have their respective male and female input-output connectors that are fitted with each other so as to establish electrical connection therebetween.

Figure 2:
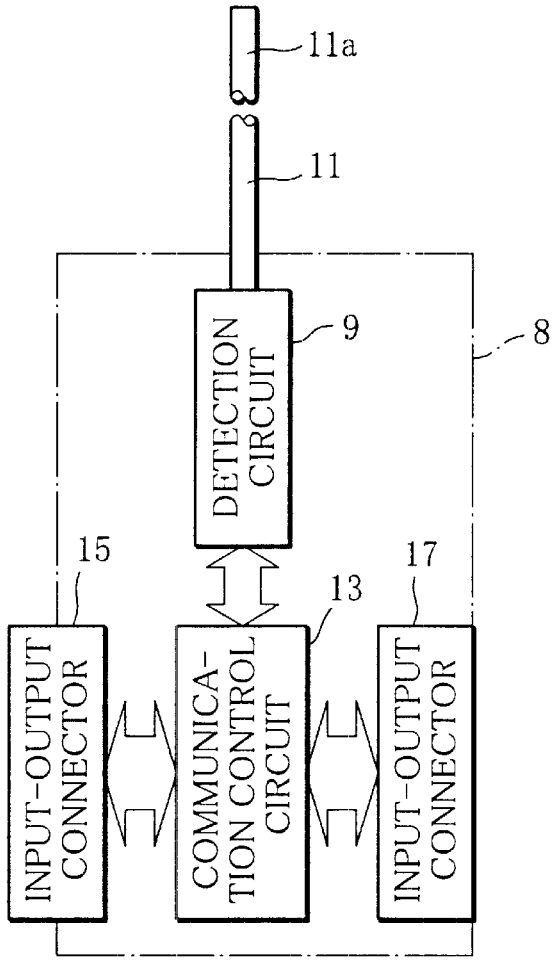
FIG. 2 is a block diagram showing the internal structure of a sensor unit.

As shown in FIG. 2, each sensor unit 8 has a detection circuit 9 accommodated therein. This detection circuit 9 is connected to a detecting element 11*a* by means of a signal conductor such as an optical fiber 11 that constitutes a signal transmission line. Although FIG. 2 illustrates a case where the sensor unit 8 has the one detecting element 11*a,* two optical fibers extending from the detection circuit 9 may be disposed such that their distal ends (detecting elements) are opposed to each other, with a workpiece transfer path located between them, so as to detect a workpiece passing between the two detecting elements.

Further, the detection circuit 9 is connected to a communication control circuit 13. This communication control circuit 13 is interposed between the male and female input-output connectors 15 and 17 of the sensor unit 8 to which it belongs. A detection signal (optical signal) detected by the detecting element is transmitted to the detection circuit 9 through the optical fiber 11 and converted from an optical signal into an electric signal by means of the detection circuit 9. Thereafter, the detection signal is delivered to the communication control circuit 13. The communication control circuit 13 can output, through one of the input-output connectors 15 and 17, e.g., through the male input-output connector 15, a detection signal supplied from the detection circuit 13 to the sensor unit 8 that is intimately disposed on the left of the control circuit as seen in FIG. 1. Also, the communication control circuit 13 can output, through the input-output connector 15, a detection signal that is received through the female input-output connector 17 from the sensor unit 8 which is closely disposed on the right of the control circuit as viewed in FIG. 1. Thus, in each of the sensor unit groups 4 and 6, each sensor unit 8 can successively transmit detection signals to the master unit 2 through the sensor unit 8 intimately disposed on the left side thereof in FIG. 1.

As mentioned later, a detection signal supplied from the sensor unit 8 located at the left end of the sensor unit group 6 is transmitted through the relay device 12 to the sensor unit 8 located at the right end of the sensor unit group 4. A detection signal from the sensor unit 8 located at the left end of the sensor unit group 4 is transmitted through another relay device 12 to the master unit 2 and further transmitted from the master unit 2 to a controller (not shown), which will be mentioned later.

In association with the delivery of detection signals, a signal-transmission-line switching operation of the communication control circuit 13 of each sensor unit 8 is carried out under the control of the master unit 2, for instance. A detailed description of the switching operation is omitted herein since such an operation has no direct connection with the present invention. In the case where the master unit controls the switching operation, a control signal is delivered from the master unit 2 to the communication control circuit 13 of each sensor unit 8. Like the delivery of the detection signal from each sensor unit 8 to the master unit 2, the delivery of the control signal to each sensor unit is carried out through the sensor units 8 interposed between the sensor unit 8 and the master unit 2 and through the relay cable 12.

It is to be understood that each of the input-output connectors 15 and 17 includes power input and output terminals. Thus, as in the case of the delivery of the detection signal and the control signal, electric power is supplied to each sensor unit 8 from the master unit 2, which is connected through the power cable 38 to an external power source, via the sensor units 8 interposed between the master unit and the sensor unit 8 in question and through the relay cable 12.

With this arrangement for signal transmission and electric power supply, the number and lengths of signal cables and power cables in the whole concatenated sensor system can be reduced.

As shown in FIG. 1, the sensor unit groups 4 and 6 are connected electrically to each other by means of the relay device 12. The relay device 12 is provided with a first relay unit 14 on the side of the sensor unit group 4 and a second relay unit 16 on the side of the sensor unit group 6. These relay units 14 and 16 are formed into a rectangular shape similar to the shape of the sensor units 8.

Figure 3:
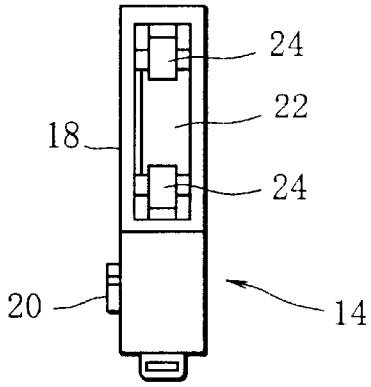
FIG. 3 is a plan view of a first relay unit.
Figure 4:
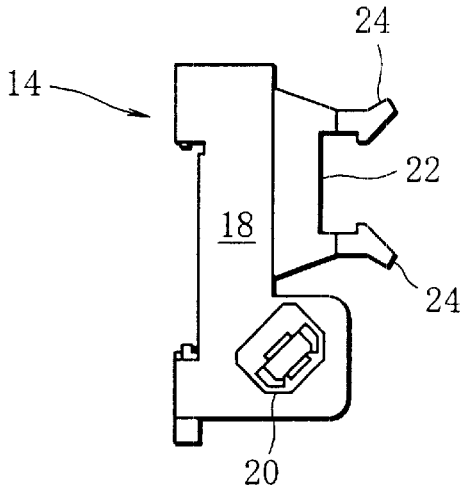
FIG. 4 is a side view of the first relay unit.

As shown in FIGS. 3 and 4, the first relay unit 14 has a male-type first linking connector 20 on its one outside wall or left outside wall 18. The first linking connector 20 is arranged to be plugged into the female input-output connector 17 of the sensor unit 8 so that it can be connected electrically to the input-output connector 17. Thus, the first linking connector 20 has the same construction as that of the male input-output connector 15 of the sensor unit 8.

When the first relay unit 14 is located on the DIN rail 10 for the sensor unit group 4, as shown in FIG. 1, the first relay unit 14 is juxtaposed in intimate contact with the sensor unit 8 located at the right end of the sensor unit group 4. In this state, the first linking connector 20 and the input-output connector 17 mate with each other, whereupon the first relay unit 14 and the sensor units 8 or the sensor unit group 4 are connected electrically to one another.

The first relay unit 14 is provided with another connector or relay connector 22, besides the first linking connector 20. The relay connector 22 is provided on an outside wall surface that is different from the left outside wall 18 of the first relay unit 14, and is connected electrically to the first linking connector 20. In the case of the illustrated embodiment, the relay connector 22 is a male or female square connector that has a pair of lock levers 24, and is provided on the upper surface of the first relay unit 14 that extends in the direction of arrangement of the master unit 2 and the sensor unit groups 4 and 6.

Figure 5:
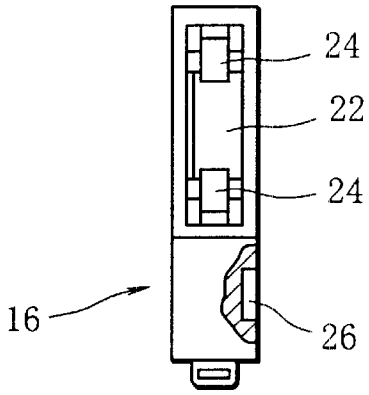
FIG. 5 is a plan view, partly broken, of a second relay unit.

On the other hand, the second relay unit 16 has a female-type second linking connector 26 on its right outside wall, as shown in FIG. 5. The second linking connector 26 is fitted to the male input-output connector 15 of the sensor unit 8 so as to be connected electrically to the input-output connector 15. Thus, the second linking connector 26 has the same construction as that of the female input-output connector 17 of the sensor unit 8.

When the second relay unit 16 is disposed on the DIN rail 10 for the sensor unit group 6, as shown in FIG. 1, the second relay unit 16 is juxtaposed in intimate contact with the sensor unit 8 located at the left end of the sensor unit group 6. In this state, the second linking connector 26 of the second rely unit 16 is fitted in the male input-output connector 15 of the sensor unit 8, so that the second relay unit 16 is electrically connected to the sensor units 8 or the sensor unit group 6.

Like the first relay unit 14, the second relay unit 16 has a relay connector 22 with lock levers 24. In this case, the relay connector 22 is connected electrically to the second linking connector 26.

As shown in FIG. 1, the relay connector 22 of the first relay unit 14 and the relay connector 22 of the second relay unit 16 are connected electrically to each other by means of the relay cable 28 with connectors. In this embodiment, the relay cable 28 is a flat cable and has opposite ends thereof provided with female or male connectors 30 that are adapted to be fitted to the relay connectors 22, respectively. These connectors 30 are prevented from slipping off by means of their paired lock levers 24 when they are caused to mate with the relay connectors 22 of the relay units 14 and 16. It is to be understood that each of the relay units 14 and 16 is provided with a mechanism (not shown) for unlocking the lock levers 24.

Figure 6:
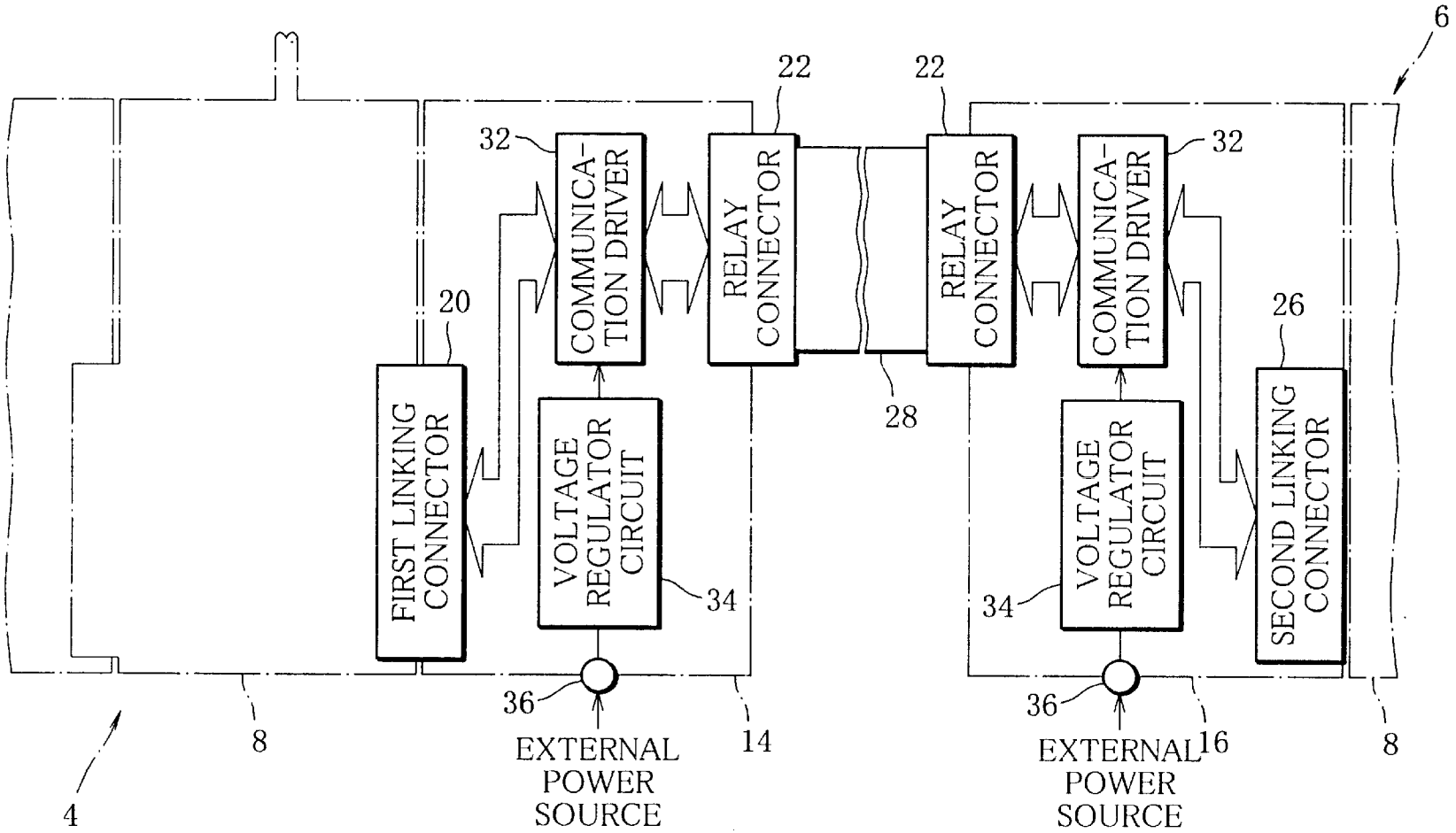
FIG. 6 is a block diagram showing the internal structures of the first and second relay units.

As shown in FIG. 6, the relay units 14 and 16 have their respective communication drivers 32 between the linking connectors 20, 26 and the relay connectors 22. Each communication driver 32 is connected to an external power terminal 36 through a voltage regulator circuit 34. The external power terminal 36 electrically connects a given external power source and the voltage regulator circuit 34, thereby enabling the voltage regulator circuit 34 to apply a given voltage to the communication driver 32. In FIG. 6, power cables (not shown) separate from the relay cables 28 are connected individually to the external power terminals 36 of the relay units 14 and 16, thereby supplying power to the communication drivers 32 through the power cables and the voltage regulator circuits 34. However, power may be supplied through the sensor unit groups interposed between the master unit 2 and the relay units 14, 16 and through the relay cables.

If the relay device 12 electrically connects the sensor unit groups 4 and 6, a detection signal from each sensor unit 8 in the sensor unit group 6 can be transmitted to the sensor unit group 4, and the transmitted detection signal is further transmitted through each sensor unit 8 in the sensor unit group 4.

As seen from FIG. 1, the sensor unit group 4 and the master unit 2 are also connected electrically to each other by means of a similar relay device 12. More specifically, the master unit 2 is located on its corresponding DIN rail 10, and has an input-output connector, similar to the female input-output connector 17 of the sensor unit 8, on its one outside wall. In this case, therefore, the relay device 12 has a first relay unit 14 on the side of the master unit 2 and a second relay unit 16 on the side of the sensor unit group 4. The first and second relay units 14 and 16 are connected electrically to each other by means of the relay cable 28. Thus, the master unit 2 can receive the detection signal from each sensor unit 8 in the sensor unit groups 4 and 6 through the relay device 12.

The power cable 38 and a master cable 39 extend from the master unit 2, and the master cable 39 is connected to a controller (not shown). Therefore, the controller can receive detection signals from the sensor units 8 in the sensor unit groups 4 and 6.

Although the master unit 2, unlike the sensor units 8, has no sensor function, it can be given the same sensor function as those of the sensor units 8. The master unit 2 may be provided at the other outside wall with an input-output connector. In this case, the master unit 2 can be connected electrically to another sensor unit group, which is located on the side opposite from the sensor unit groups 4 and 6, by means of a similar relay device.

Figure 7:
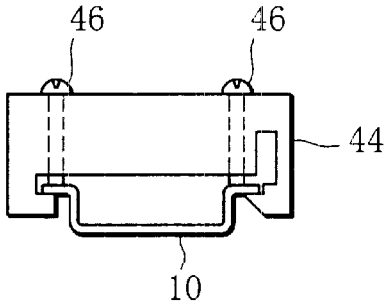
FIG. 7 is a side view of an end plate.

End plates 44 are located individually on the opposite sides of the sensor unit group 4 (in other words, an assembly formed of the relay units 14 and 16 and the sensor unit group 4) that is provided with the first and second relay units 14 and 16. These end plates 44 hold the sensor unit group 4, which is provided with the first and second relay units 14 and 16, in a given position on the DIN rail 10. Thus, the end plates 44 disposed on the opposite sides hold the sensor unit group 4 from both sides with the aid of the first and second relay units 14 and 16, and in this state, are fixed to the DIN rail 10 by means of a pair of clamp screws 46, as shown in FIG. 7.

The sensor unit group 6, which is provided with the second relay unit 16 on one side, and the master unit 2, which is provided with the first relay unit 14 on one side thereof, are also fixed individually in given positions on their corresponding DIN rails 10 by means of paired end plates 44.

According to the relay device 12 described above, the first and second relay units 14 and 16 have their respective relay connectors 22, besides their linking connectors 20 and 26, so that these relay connectors 22 themselves can be furnished with an optional lock mechanism. Thus, the relay connectors 22 can be configured in the form of square connectors with lock levers, as mentioned before. These square connectors with lock levers, which have satisfactory tensile strength, can securely prevent the relay cables 28 from slipping out of the relay connectors 22. Since the first and second relay units 14 and 16, along with the master unit 2 and the sensor unit groups 4 and 6, are fixed tight on the DIN rails 10, the electrical connections between the master unit 2 and the sensor unit group 4 and between the sensor unit groups 4 and 6 can be secured with reliability.

Further, the respective communication drivers 32 of the first and second relay units 14 and 16 serve to increase transmission power for the detection signals. Hence, the relay cables 28 are allowed to be elongated, and the maximum distance of separation or relay distance between the sensor unit groups 4 and 6 can be lengthened. Since the communication drivers 32 are located in their corresponding relay units, their heat generation never exerts a bad influence on the circuits in the sensor units 8. Thus, high-power communication drivers are available.

Further, the respective communication drivers 32 of the first and second relay units 14 and 16 can be supplied with power from the external power source through the voltage regulator circuits. 34, so that communication drivers of higher power can be used without being restricted by the power consumption of the communication drivers 32 themselves. Thus, further elongation of the relay distance can be facilitated.

The present invention is not limited to the embodiment described above, and various modifications may be made therein. For example, the relay connectors 22 and the connectors on the relay cable may be coupled by screwing without the use of the lock levers 24, and the relay cable may be formed integrally with one or both of the first and second relay units.

Furthermore, the relay cable 28 is not limited to a flat cable and may be a cylindrical cable.

It is to be understood that the relay device 12 can relay signals and power between the master unit and the sensor units as well as between the sensor unit groups, as shown in FIG. 1. Furthermore, both the first and second relay units 14 and 16 may have the first and second linking connectors 20 and 26 on their respective opposite outer surfaces.

Although the end plates 44 are provided separately from the relay units 14 and 16 in the embodiment described above, they may be provided integrally with one another. Although the master unit 2 and the sensor unit groups 4 and 6 are set individually on the three bases 10, they may be set on one base, for example.

What is claimed is:

1. In a concatenated sensor system including a first unit group (4 or 2) comprised of at least one sensor unit (8) or a master unit (2) and a second unit group (4 or 6) comprised of at least one sensor unit (8), a relay device for the concatenated sensor system comprising:

a first relay unit (14) adapted to be juxtaposed in intimate contact with one side of said first unit group and adapted to be fixed, together with said first unit group, to a first base (10), said first relay unit including a first linking connector (20) electrically connectable with a first input-output connector (17) on said one side of said first unit group;

a second relay unit (16) adapted to be juxtaposed in intimate contact with another side of said second unit group and adapted to be fixed, together with said second unit group to, a second base (10), said second relay unit including a second linking connector (26) electrically connectable with a second input-output connector (15) on said another side of said second unit group; and a relay cable (28) electrically connecting said first relay unit and said second relay unit.

2. A relay device/for a concatenated sensor system according to claim 1, wherein said relay cable (28) is connected to said first and second relay units (14, 16) at those outer surfaces of said first and second relay units (14, 16) which extend in a direction of arrangement of said first and second unit groups.

3. A relay device for a concatenated sensor system according to claim 2, wherein said relay cable (28) has opposite ends thereof provided with connectors (30) that are adapted to be connected individually to relay connectors (22) provided on said outer surfaces of said first and second relay units (14, 16).

4. A relay device for a concatenated sensor system according to claim 1, wherein end plates (44) are arranged in intimate contact with that side of said first relay unit (14) which is remote from the first unit group and that side of said second relay unit (16) which is remote from the second unit group, said end plates being fixed to said first and second bases (10), individually.

5. A relay device for a concatenated sensor system according to claim 4, wherein at least one (4 or 6) of said first and second unit groups is composed of a plurality of sensor units (8), the end plates (44) being each arranged in intimate contact with that side of said sensor unit group (4 or 6) which is remote from the relay unit and each fixed to the corresponding one of said first and second bases (10).

6. A relay device for a concatenated sensor system according to claim 1, further comprising:

a signal conductor (11) extending from each said sensor unit (8) to a detecting element (11*a*) thereof, said signal conductor being formed of an optical fiber.

7. A relay device for a concatenated sensor system according to claim 1, wherein at least one of said first and second relay units (14, 16) includes a communication driver (32) between the linking connector (20 or 26) and the relay cable (28).

8. A relay device for a concatenated sensor system according to claim 7, wherein said relay unit (14 or 16) provided with said communication driver (32) includes power supply means (34, 36) through which externally power is supplied to the communication driver.

* * * * *

UNITED STATES PATENT AND TRADEMARK OFFICE

CERTIFICATE OF CORRECTION

PATENT NO. : 6,452,162 B1 
DATED : September 17, 2002
INVENTOR(S) : Hisashi Matsuno et al.

It is certified that error appears in the above-identified patent and that said Letters Patent is hereby corrected as shown below:

Title page,
Item [54], Title, change "REPEATER OF TANDEM SENSOR SYSTEM" to
-- RELAY DEVICE FOR CONCENTENATED SENSOR SYSTEM --

Signed and Sealed this

Twenty-second Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,452,162 B1 
DATED : September 17, 2002
INVENTOR(S) : Hisashi Matsuno et al.

It is certified that error appears in the above-identified patent and that said Letters Patent is hereby corrected as shown below:

Title page,
Item [54], Title, change "REPEATER OF TANDEM SENSOR SYSTEM" to
-- RELAY DEVICE FOR CONCATENATED SENSOR SYSTEM --

This certificate supersedes Certificate of Correction issued April 22, 2003.

Signed and Sealed this

Third Day of June, 2003

JAMES E. ROGAN
*Director of the United States Patent and Trademark Office*